United States Patent [19]

Sakaida et al.

[11] Patent Number: 4,767,226

[45] Date of Patent: Aug. 30, 1988

[54] PRINT HEAD WITH WIRES WHICH CONTINUOUSLY CONTACT THE TIP GUIDE

[75] Inventors: Atsuo Sakaida, Gifu; Masafumi Kawaura, Nagoya; Yasuji Chikaoka, Aichi; Hiroshi Iwata, Nagoya; Kiyomitsu Asano, Musashino, all of Japan

[73] Assignee: Brother Kogyo Kabushiki Kaisha, Tokyo, Japan

[21] Appl. No.: 946,680

[22] Filed: Dec. 29, 1986

Related U.S. Application Data

[63] Continuation of Ser. No. 659,728, Oct. 11, 1984, abandoned.

[30] Foreign Application Priority Data

Oct. 20, 1983 [JP] Japan ..... 58-163205[U]

[51] Int. Cl.[4] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,167,343 | 9/1979 | Golobay | 400/124 |
| 4,180,333 | 12/1979 | Linder | 400/124 |
| 4,403,875 | 9/1983 | Asano et al. | 400/124 |

FOREIGN PATENT DOCUMENTS

| | | | |
|---|---|---|---|
| 56-137974 | 10/1981 | Japan | 400/124 |
| 57-84869 | 5/1982 | Japan | 400/124 |
| 57-93168 | 6/1982 | Japan | 400/124 |
| 58-8665 | 1/1983 | Japan | 400/124 |
| 58-87062 | 5/1983 | Japan | 400/124 |
| 58-163670 | 9/1983 | Japan | 400/124 |
| 2071019 | 9/1981 | United Kingdom | 400/124 |

OTHER PUBLICATIONS

"Wire Matrix Print Head Guide Means"; R. A. Rachui; *IBM Technical Disclosure Bulletin;* vol. 23, No. 7B, Dec. 1980, pp. 3072–3073.

*Primary Examiner*—David Wiecking

*Attorney, Agent, or Firm*—Jones, Tullar & Cooper

[57] ABSTRACT

Disclosed is a print head for a printer which performs a printing operation with dots on a printing medium. The print head is provided with an armature and a wire holder fixed to the armature. A print wire is rigidly joined to the free end of the wire holder. The forward end portion of the print wire extends toward the printing medium through a guide slot formed in a guide member. The side surface of the forward end portion of the print wire on the side opposite to the side on which the armature is disposed slides along the wall defining the guide slot at least during the printing operation.

7 Claims, 4 Drawing Sheets

PRINT HEAD WITH WIRES WHICH CONTINUOUSLY CONTACT THE TIP GUIDE

This is a continuation of co-pending application Ser. No. 659,728 filed on Oct. 11, 1984, now abandoned.

BACKGROUND OF THE INVENTION

The present invention relates to a print head used in, for example, a wire matrix printer which performs its printing operation with dots impressed on a printing medium.

A print head of this type comprises an actuator rockable about its own axis and a print wire joined to the free end of the actuator. The actuator is reciprocated to enable the print wire to impress dots on the printing medium so as to perform the printing operation. Depending on the driving system of the actuator, the print head can be classified into, for example, a plunger type, a clapper type and a spring charge type. Included in the spring charge type is a so-called "release-type" print head which comprises a driving means of the actuator consisting of a solenoid, a permanent magnet and a torsion rod. In general, the torsion rod is held in its rest position by the attracting force of the permanent magnet so as to store the energy of torsion spring in the rod. When the printing operation is performed, the solenoid is energized to cancel the attracting force of the permanent magnet, with the result that the energy stored in the torsion rod is released. To be more specific, the actuator is urged in the printing direction by the torsion spring force of the torsion rod. Under the inactive state of the print head, the actuator is held in the rest position by the magnetic force of the permanent magnet, with the result that the torsion energy is stored in the torsion rod. During the printing operation, the magnetic force generated from the solenoid serves to offset the magnetic force of the permanent magnet so as to release the energy of the spring force stored in the torsion rod. The release-type print head outlined above is disclosed in, for example, U.S. Pat. No. 4,167,343 and Japanese patent Disclosure No. 58-8665.

In any type of the print heads described above, the print wire receives the reaction force accompanying the printing impact. As a result, the forward end portion of the print wire tends to be vibrated or bent. To overcome this defect, guide means is mounted to, particularly, the forward end portion of the print wire. In general, a guide member formed of a part of, for example, the casing of the print head is provided with a guide slot so as to provide the guide means. The forward end portion of the print wire is guided through the guide slot to the printing medium, with a small clearance left between the print wire and the wall defining the guide slot.

In the past, it was thought desirable for the print wire not to contact the wall of the guide slot during the normal printing operation. Specifically, the contact of the print wire with the wall of the guide slot was thought to promote wear of the print wire, leading to loss of the operating energy of the print wire. It has been found, however, that a serious defect is brought about if the print wire is not in contact with the wall of the guide slot during the normal printing operation. It should be noted that it is unavoidable for the forward end portion of the print wire to be vibrated by the printing impact. As a result, the printed letters are deformed or made nonuniform as the printing speed is increased.

In addition, a lateral external force is given by the printing medium or the ink ribbon to the forward end portion of the print wire, because the print head moves in parallel with the printing medium during the normal printing operation. What should be noted is that the lateral external force mentioned above always acts as a pulling or tensile force during the printing operation so as to cause the joint portion of the print wire to be pulled away from the actuator. As a result, the joint portion tends to be broken easily, leading to a low durability of the print head.

SUMMARY OF THE INVENTION

An object of the present invention is to provide a print head used in, for example, a wire matrix printer, which is simple in construction and permits greatly suppressing a pulling or tensile force applied to the joint portion of the print wire during the printing operation. It follows that the present invention makes it possible to markedly improve the durability of the print head and produce a high quality print.

To achieve the above-noted object, the print head of the present invention is constructed such that a print wire is engaged with guide means at least during the printing operation. What should be noted is that the engagement is performed on the side surface of the print wire on the side opposite to the side on which an actuator or armature means is disposed. The guide means may be of a guide slot shape or any optional shape. Also, the engagement of the print wire with the guide means may be performed in the rest position of the print wire. However, in order to avoid wear of the print wire caused by the engagement mentioned above, it is desirable to employ a construction which permits the engagement only during the printing operation, particularly, only in the latter half of the printing stroke.

The particular construction described above permits highly stabilizing the position of the forward end portion of the print wire during the printing operation, making it possible to obtain a clear print of a high quality. It should also be noted that the side surface of the print wire on the opposite side remote from the actuator or armature means abuts against the guide means, with the result that, even if a lateral force is applied during the printing operation from the ink ribbon or printing medium to the print wire, a pulling force is not given to the joint portion of the print wire. Naturally, the joint portion is substantially free from breakage during the printing operation, leading to a highly improved durability of the print head.

Other features and advantages of the invention will be apparent from the following description taken in conjunction with the accompanying drawings.

DETAILED DESCRIPTION OF THE PREFERRED EMBODIMENT

Figure 1:
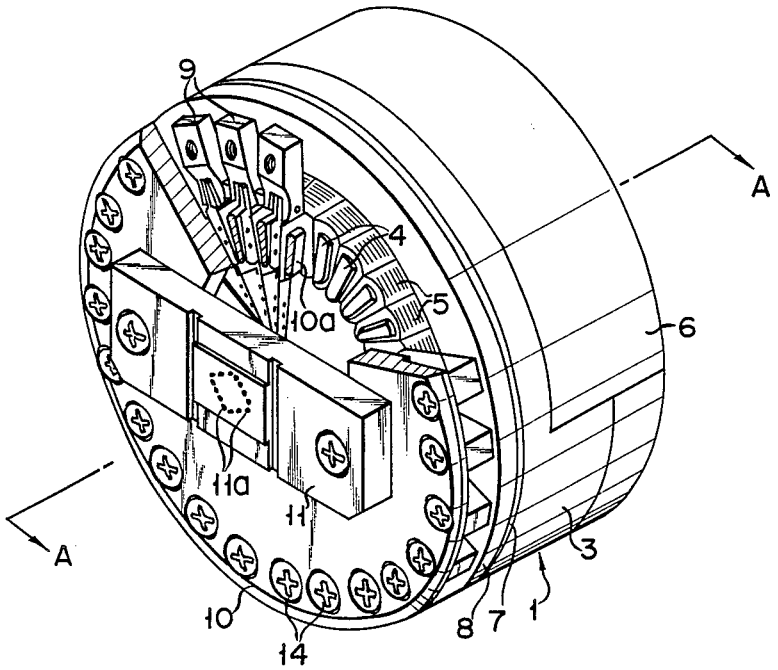
FIG. 1 is a perspective view, partly broken away, of a print head according to an embodiment of the present invention.

The accompanying drawings collectively show a print head according to an embodiment of the present invention. The print head shown in the drawings is suitable for use in a wire matrix printer. The print head comprises a yoke member 1 forming a magnetic flux path. The yoke member 1, which is formed of a Co-Fe alloy called "permendur" and having a high saturation magnetic flux density, consists of a cylindrical outer yoke 3 and an inner yoke 2 radially apart from the outer yoke 3. A number of yoke pieces 4 arranged a prescribed distance apart from each other to form a circle are formed integrally with the inner yoke 2. Each of the yoke pieces 4 is wound with a solenoid coil 5 so as to provide a solenoid assembly acting as a magnetic means.

Figure 2:
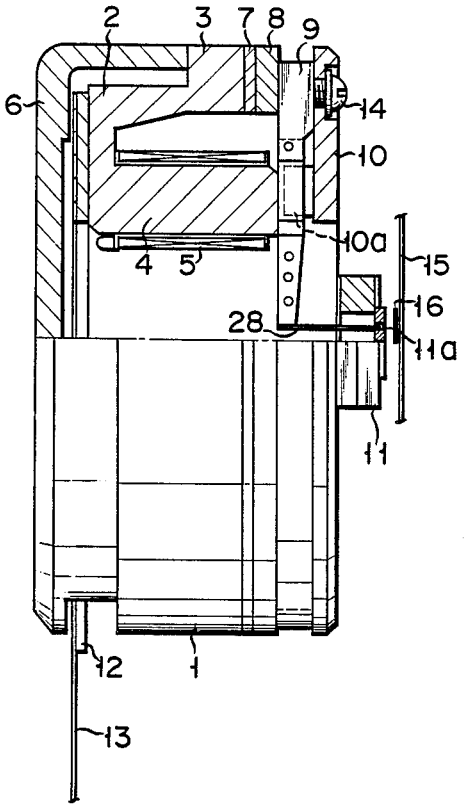
FIG. 2 is a sectional side view along the line A—A shown in FIG. 1, showing that a print wire is in its rest position, the upper half of FIG. 2 showing the internal structure.

As shown in FIG. 2, a rear casing 6 forming a part of the casing of the print head is fixed to the outer yoke 3. Also, a front yoke 10 forming the remaining part of the print head casing is disposed on the front side. As seen from the drawings, an annular permanent magnet 7 providing another magnetic means and an annular holding member 8 are disposed between the yoke member 1 and the front yoke 10. The magnet 7 is held between the yoke member 1 and the holding member 8.

A number of print wire-actuator assemblies 9 are circumferentially arranged behind the front yoke 10 a prescribed distance apart from each other so as to correspond to the yoke pieces 4. Each assembly 9, which extends radially as shown in FIG. 1, is fixed to the front yoke 10 by a bolt 14. Also, the position of the assembly 9 is determined by a pin (not shown) mounted on that side of the holding member 8 which faces the assembly 9. In this embodiment, 24 print wire-actuator assemblies 9 are provided together with the same number of yoke pieces 4.

Figure 3:
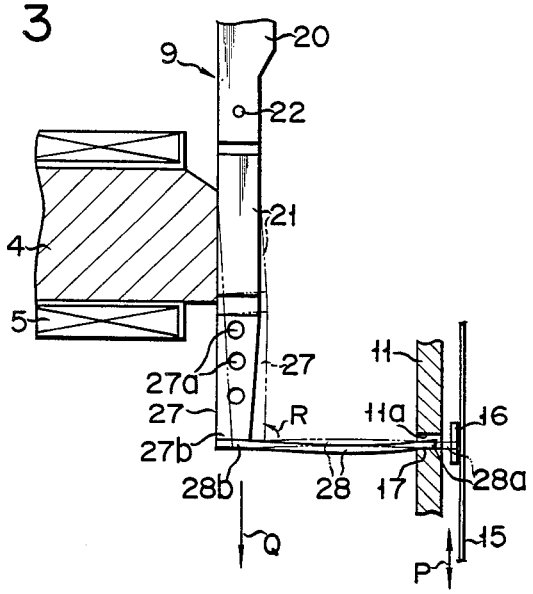
FIG. 3 schematically shows the construction of the gist portion of the present invention in which a print wire is slidably guided within a guide slot.

As seen from FIG. 3, each assembly 9 comprises a stationary supporting block 20, a torsion rod 22 mounted on the block 20, an armature 21 rigidly fixed to the rod 22, and a wire holder 27 fixed to the armature 21. The armature 21 and the wire holder 27 collectively form armature means or actuator means rockable about the axis of the torsion rod 22. Also, the supporting block 20 and the torsion rod 22 collectively form support means for rockably supporting the armature 21 and the wire holder 27. Further, the torsion spring force of the torsion rod 22 is allowed to act on the actuator or armature means so as to enable a print wire 28 to perform a printing operation as described later. In other words, the torsion rod 22 acts as driving means or spring means.

The armature 21 is normally pulled by the magnetic force of the permanent magnet 7 so as to abut against the end face of the yoke piece 4, with the result that the torsion energy is stored in the rod 22.

A number of projections 10*a* are formed behind and integrally with the front yoke 10 as denoted by a broken line in FIG. 2. These projections 10*a* interdigitate with the armatures 21 and form a magnetic circuit together with the print wire-actuator assemblies 9 and the yoke pieces 4.

A guide member 11 is mounted on the central portion of the front surface of the front yoke 10. As seen from FIG. 1, the guide member 11 is provided with guide slots 11*a* arranged in a diamond shape.

The lead wire of the solenoid coil 5 wound about the yoke piece 4 is connected to a power source disposed within a printer body (not shown) through a flexible electric cable 13 attached to a substrate 12 (FIG. 2). Of course, an exciting current is selectively supplied to the solenoid coils 5 through the cable 13.

As shown in FIG. 3, the forward end portion 28*a* of a print wire 28 extends through the guide slot 11*a* formed in the guide member 11 toward an ink ribbon 16 and a printing medium 15 disposed near the ribbon 16. It should be noted that only a slight clearance is left between the forward end portion 28*a* of the print wire 28 and the wall defining the guide slot 11*a*. The print wire 28, which is normally located in the inactive position, i.e., the rest position, denoted by a solid line in FIG. 3, is moved forward toward the printing medium 15 as denoted by a broken line during the printing operation. In this step, the forward end portion 28*a* of the print wire 28 slides along the wall of the guide slot 11*a*. To be more specific, the forward end portion 28*a* is engaged with the wall of the guide slot 11*a* on the side surface 17 opposite to the side on which the armature 21, the supporting block 20 and the torsion rod 22 are disposed. In this embodiment, the side surface 17 of the forward end portion 28*a* is kept engaged with the guide slot 11*a* even when the print wire 28 is in its rest position as seen from FIG. 3. Under this condition, the print wire 28 is slightly bent as seen from the drawing. In other words, the side surface 17 of the print wire 28 is kept resiliently engaged with the guide slot 11*a*.

Figure 4:
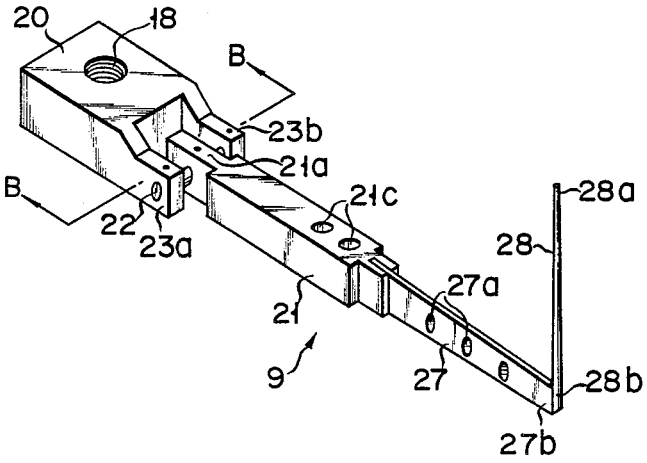
FIG. 4 is a perspective view showing a print wire-actuator assembly constructed such that a print wire is joined to the free end of the actuator.
Figure 5:
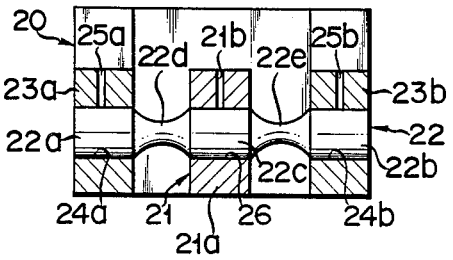
FIG. 5 is an enlarged cross sectional view along the line B—B shown in FIG. 4.
Figure 6:
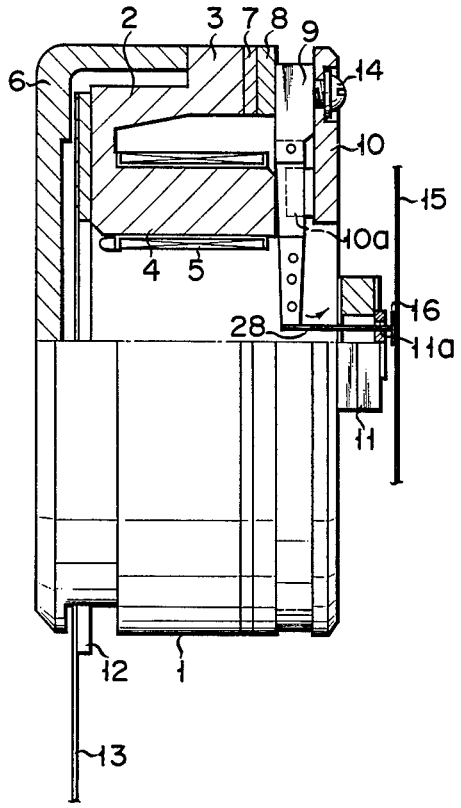
FIG. 6 is a sectional side view corresponding to FIG. 2 and showing the printing state of the print wire.

FIGS. 4 and 5 collectively show the print wire-actuator assembly 9. It is seen that the supporting block 20 is provided with a threaded hole 18, which is engaged with the bolt 14, and a pair of arms 23*a*, 23*b*. Through-holes 24*a*, 24*b* are formed in the arms 23*a*, 23*b*, respectively. Also, the arms 23*a*, 23*b* are provided with holes 25*a*, 25*b*, respectively. These holes 25*a*, 25*b* extend in a direction perpendicular to the axis of the holes 24*a*, 24*b* and are loaded with a soldering material. The torsion rod 22 is soldered to the supporting block 20 utilizing the soldering material loaded in the holes 25*a*, 25*b*. A pellet-like or rod-like soldering material consisting of palladium, gold or silver is used in the present invention.

The material used for forming the yoke member 1 is also used for forming the armature 21. Specifically, the armature 21 is formed of a Co-Fe alloy called permendur which has a high saturation magnetic flux density. As a result, a magnetic circuit is formed by the armature 21, the yoke piece 4 and the projection 10*a* (FIG. 2).

A through-hole 26 is formed in one end portion 21*a* of the armature 21, i.e., the end portion 21*a* positioned between the arms 23*a* and 23*b*. The central portion 22*c* of the torsion rod 22 in its axial direction is inserted into the hole 26. It should be noted that a soldering material is loaded in a hole 21*b* extending in a direction perpendicular to the axis of the through-hole 26 so as to solder the torsion rod 22 to the armature 21.

The wire holder 27, which is soldered to the forward end portion of the armature 21 so as to form armature means together with the armature 21, extends linearly in the axial direction of the armature 21. The forward end portion 27*b* of the wire holder 27 constitutes the free end of the armature means. The base end portion of the print wire 28 is rigidly fixed by soldering to the forward end portion 27*b* of the wire holder 27 and constitutes a joint portion 28*b*. The print wire 28 is formed of a flexible wire tapered from the joint portion 28*b* toward the forward end portion 28*a* and extends in a direction perpendicular to the extending direction of the wire holder 27.

A pair of holes 21*c* is formed in the armature 21 near the end to which the wire holder 27 is joined so as to delete the excess material of the armature 21, which is unnecessary for the magnetic circuit formed by the armature 21, the projection 10*a*, etc., and, thus, to decrease the weight of the armature 21. Similarly, three holes 27*a* are formed in the wire holder 27.

It is desirable for the torsion rod 22 to be formed of maraging steel, i.e., a high nickel steel with an extremely low carbon content, or JIS (Japanese Industrial Standards) 15-7PH or 17-7PH stainless steel, which is a martensite of precipitation hardening type. Both end portions 22*a*, 22*b* of the rod 22 are inserted into the holes 24*a*, 24*b* of the arms 23*a*, 23*b*, with the central portion 22*c* inserted into the hole 26 formed at the end portion 21*a* of the armature 21. As seen from FIG. 5, these end portions 22*a*, 22*b* and the central portion 22*c* of the rod 22 are equal to each other in diameter and are of a stub shape. On the other hand, the intermediate portions 22*d*, 22*e* of the rod 22 are of a trumpet shape. In other words, a gently curved concave outer surface is formed in the axial direction of the intermediate portions 22*d*, 22*e*. Because of the particular shape, the torsion stress generated in the torsion rod 22 during the printing operation is uniformly distributed in the axial direction of the intermediate portions 22*d*, 22*e*. Thus, it is possible to prevent the stress from being concentrated in the boundary regions between the intermediate portions 22*d*, 22*e* and the end portions 22*a*, 22*b* and between the intermediate portions 22*d*, 22*e* and the central portion 22*c*, leading to a long life of the torsion rod 22.

The print head of the construction described above performs its printing operation as described in the following. Specifically, the armature 21 is pulled by the magnetic force of the permanent magnet 7 to abut against the yoke piece 4, when the solenoid coil is not excited, as shown in FIG. 2. Under this condition, torsion spring energy for urging the armature 21 to be rocked in the printing direction is stored in the torsion rod 22 acting as the spring means, and the forward end portion 28*a* of the print wire 28 is positioned somewhat inside the front edge of the guide slot 11*a* of the guide member 11, i.e., the forward end portion 28*a* is in its rest position. In the rest position, the side surface 17 of the forward end portion 28*a* is resiliently engaged with the wall defining the guide slot 11*a*.

An exciting current is selectively supplied to the solenoid coil 5 through the flexible cable 13 on the basis of the printing signal generated from the printer body (not shown). When the current is supplied to the solenoid coil 5, a magnetic circuit is formed by the armature 21, the yoke piece 4 and the projection 10*a* so as to produce a magnetic force equal in magnitude and opposite in direction to the magnetic force generated from the permanent magnet 7. As a result, the magnetic force of the permanent magnet 7 is offset or canceled. It follows that the torsion spring energy of the torsion rod 22 is released to urge the armature 21 to rotate about the axis of the rod 22, with the result that print wire 28 performs its printing stroke toward the printing medium 15. In other words, the forward end portion 28*a* of the print wire 28 projects from the front edge of the guide slot 11*a* of the guide member 11 to perform matrix printing of a letter or character with dots on the printing medium 15 via the ink ribbon 16.

Where the printing medium 15 is formed of a pressure sensitive paper sheet, the ink ribbon 16 need not be used. Also, a platen supporting the printing medium 15 and feeding devices for the printing medium 15 and the ribbon 16 may be of the conventional construction and, thus, are omitted in the drawings.

During the printing operation, the side surface 17 of the forward end portion 28*a* of the print wire 28 on the side opposite to the side on which the armature 21 is disposed slides along the wall of the guide slot 11*a*, as shown in FIG. 3. Thus, vibration of the forward end portion 28*a* is substantially prevented when the print wire 28 receives the mechanical shock of printing impact, making it possible to achieve clear printing on the printing medium 15. Also, even if the forward end portion 28*a* receives a lateral external force as denoted by an arrow P by the contact with the printing medium 15 or the ink ribbon 16, the component Q of the force serving to move the joint portion 28*b* away from the forward end portion 27*b* of the wire holder 27 is absorbed by the engagement between the forward end portion 28*a* of the print wire 28 and the guide slot 11*a*. In other words, the component Q does not act on the joint portion 28*b*. On the contrary, a compressive force pushing the joint portion 28*b* toward the wire holder 27 is generated during the printing operation, as denoted by an arrow R. It follows that the joint portion 28*b* is prevented from being removed from the wire holder 27, leading to a long life of the print head.

In the embodiment described above, the forward end portion of the print wire is kept engaged with the guide slot only when the print wire is in its rest position. However, the print wire may be left disengaged from the guide slot when the print wire is in its rest position. In this case, the forward end portion is allowed to slide along the wall of the guide slot only during the latter half of its printing stroke. This modification can be achieved easily by slightly changing the length and shape of the guide slot. Also, a guide slot is used as the guide means in the embodiment described above. However, the guide means may be provided by a wall provided with a sliding surface which faces the side surface of the forward end portion of the print wire.

What is claimed is:

1. A print head for a printer which performs a printing operation with dots on a printing medium consisting of:

a plurality of actuator means each rockable about its own axis and having a free end defining an end surface, said actuator means extending in a given direction;

a plurality of print wires each being associated with a corresponding actuator means and constituting a print wire-actuator assembly with its associated actuator means, each of said print wires having a base end portion, first and second opposed side surfaces and a forward end portion, said base end portion being rigidly attached at the first side surface by soldering to the end surface of the free end of the corresponding actuator means and the forward end portion extending toward the printing medium in a direction substantially perpendicular to said given direction of the actuator means;

drive means acting on the actuator means to drive the print wire from a rest position toward the printing medium during a printing operation;

restoring means acting on the actuator means to return the print wire back to the rest position; and guide means for slidably guiding only respective forward end portion of all the print wires, said guide means including a plurality of guide slots, each guide slot being fixedly positioned adjacent to the printing medium and into which said forward end portion of a corresponding print wire is inserted, each guide slot being provided with a bearing side wall which faces said second surface of the corresponding print wire, each of said print wires being biased so that the forward end portion of the respective print wire is kept in positive engagement with the corresponding bearing side wall at the second side surface of the respective print wire at all times.

2. The print head according to claim 1, wherein the drive means includes a torsion rod attached to the actuator means and extending along the axis about which the actuator means is rocked.

3. A print head for a wire matrix printer which performs a printing operation with dots on a printing medium consisting of:

a plurality of print wire-actuator assemblies each including armature means and support means for rockably supporting the armature means, said armature means extending in a given direction and having a free end defining an end surface;

a plurality of print wires each having a base end portion, first and second opposed side surfaces and a forward end portion, said base end portion being rigidly attached at the first side surface by soldering to the end surface of the free end of a corresponding armature means and having a forward end portion extending toward the printing medium in a direction substantially perpendicular to said given direction of the corresponding actuator means;

spring means for urging the armature means to move the print wire from a rest position toward the printing medium;

first magnetic means magnetically associating with the armature means to hold the print wire in the rest position thereby storing spring energy in the spring means;

second magnetic means magnetically associating with the armature means to cancel the magnetic force of the first magnetic means during a printing operation as as to release the spring energy of the spring means to perform the printing operation; and guide means for slidably guiding only the respective forward end position of all the printing wires, said guide means including a plurality of guide slots, each guide slot being fixedly positioned adjacent to the printing medium and into which said forward end portion of a corresponding print wire is inserted, said guide slot being provided with a bearing side wall which faces said second surface of a corresponding print wire, each of said print wires, being biased so that the forward end portion of the respective print wire is kept in positive engagement with the corresponding bearing side wall at the second side surface of the respective print wire at all times.

4. The print head according to claim 3, wherein the support means includes a torsion rod which also acts as the spring means serving to impart to the armature means torsion energy which allows the print wire to be driven toward the printing medium during the printing operation.

5. The print head according to claim 4, wherein the support means further includes a block to which the torsion rod is rigidly fixed at both end portions thereof, and said armature means is rigidly fixed to the central portion of the torsion rod and spaced from the block.

6. The print head according to claim 5, wherein the torsion rod includes a trumpet-shaped concave portion in the region between the armature means and the block apart from the armature means.

7. The print head according to claim 3, wherein the armature means includes an armature and a wire holder having one end fixed to the armature with the other end defining said free end of the armature means, said armature and wire holder being substantially aligned to extend linearly in said given direction.

* * * * *

UNITED STATES PATENT AND TRADEMARK OFFICE

CERTIFICATE OF CORRECTION

PATENT NO. : 4,767,226

DATED : August 30, 1988

INVENTOR(S) : Atsuo Sakaida, Masafumi Kawaura, Yasuji Chikaoka, Hiroshi Iwata and Kiyomitsu Asano It is certified that error appears in the above-identified patent and that said Letters Patent is hereby corrected as shown below:

On the title page assignee should read

-- Brother Kogyo Kabushiki Kaisha,
Nagoya, Japan and
Nippon Telecommunication Engineering
Company, Tokyo, Japan --.

Claim 3, column 8, line 6, the first "as" should read --so--.

Claim 4, column 8, line 25, before "torsion energy" insert - - the - -.

Signed and Sealed this

Eleventh Day of April, 1989

*Attest:*

*Attesting Officer*

DONALD J. QUIGG

*Commissioner of Patents and Trademarks*